US005916827A

United States Patent [19]

Vayda

[11] Patent Number: 5,916,827

[45] Date of Patent: Jun. 29, 1999

[54] COMPOSITE BRIQUETTE FOR ELECTRIC FURNACE CHARGE

[75] Inventor: Pierre Vayda, Burlington, Canada

[73] Assignee: Exothermic Distribution Corporation, Ontario, Canada

[21] Appl. No.: 09/106,076

[22] Filed: Jun. 29, 1998

Related U.S. Application Data

[60] Provisional application No. 60/054,569, Aug. 1, 1997.

[51] Int. Cl.[6] ..... C10L 5/02

[52] U.S. Cl. ..... 44/580; 44/591

[58] Field of Search ..... 44/580, 591

[56] References Cited

U.S. PATENT DOCUMENTS

| | | | |
|---|---|---|---|
| 4,230,460 | 10/1980 | Maust, Jr. | 44/580 |
| 4,738,685 | 4/1988 | Goleczka et al. | 44/580 |
| 4,787,913 | 11/1988 | Goleczka et al. | 44/591 |
| 4,802,890 | 2/1989 | Viles | 44/591 |
| 5,264,007 | 11/1993 | Lask | 44/591 |
| 5,453,103 | 9/1995 | Ford, Jr. | 44/591 |

*Primary Examiner*—Jacqueline V. Howard
*Attorney, Agent, or Firm*—Shoemaker and Mattare, Ltd.

[57] ABSTRACT

There is disclosed a briquette and a method of making the briquette, wherein the briquette includes a first quantity of carbon fines and a second quantity of a material in powdered form which contains iron or a similar metal, or an oxide thereof, the second quantity being sufficiently large that the slippery nature of the carbon fines is suppressed, and the overall density of the briquette is increased.

14 Claims, No Drawings

COMPOSITE BRIQUETTE FOR ELECTRIC FURNACE CHARGE

This application claims the benefit of Provisional Application Ser. No. 60,054,569 filed Aug. 1, 1997.

This invention relates to charges for electric furnaces, and has to do particularly with a composite briquette for use with such furnaces.

BACKGROUND OF THIS INVENTION

In a steelmaking shop utilizing electric furnaces, an electric furnace charge is typically made from scrap metal, carbon and fluxes such as lime and/or dolime, all in pieces having a minimum size of ½ inch.

It is known to add specific materials to a furnace charge in the form of briquettes. However, carbon, which is an essential part of the mixture of materials, is quite slippery in its powdered or comminuted form. Consequently, carbon is typically employed in a non-pulverized state, for example as coke. It would be of advantage to be able to utilize carbon "fines", for example those recovered from a dust collector, and to recycle such fines in their powdered or dust state. A further problem relates to the density of carbon, which is quite low compared generally to the metals. For example, when carbon is added to the furnace via a charge bucket, it will tend to float on top of the liquid metal, thus decreasing the yield of carbon in solution in the steel.

GENERAL DESCRIPTION OF THIS INVENTION

Accordingly, one aspect of this invention is to provide a briquette which is a blend of carbon and a powdered metal, thereby densifying the mixture, and in which there is sufficient of the metal to suppress the slippery nature of the carbon fines. Additional materials, fluxes, etc. may also be included. From 1–10% of a conventional binder, such as molasses, resin binders, cement, etc. (alone or in any combination) would be added to the mixture for cohesion.

More particularly, this invention provides, for addition to the charge in a steelmaking furnace, a briquette comprising:

from 1–10% by weight of a binder;

a first quantity of carbon fines;

a second quantity of a material in powdered form, selected from the group consisting of iron, chromium, nickel, iron oxide, chromium oxide, nickel oxide, and any mixtures thereof, thereby to densify the briquette;

said second quantity being large enough to suppress the slippery nature of the carbon fines, said second quantity being in the range from about 25% to about 75%, by weight, of the briquette.

Further, this invention provides a method of improving the slag-covered charge in a steelmaking furnace, comprising the steps:

making a mixture of a first quantity of carbon fines obtained from dust collector fines, and a second quantity of a material in powdered form, the material being selected from the group consisting of iron, chromium, nickel, iron oxide, chromium oxide, nickel oxide, and any mixtures thereof, said second quantity densifying the mixture and being sufficient large that the slippery nature of the carbon fines is suppressed;

compressing a portion of said mixture in a suitable mold to make a briquette; and introducing said briquette to the charge below the slag in the steelmaking furnace so that said material in powdered form contained in the briquette will cause the same to sink into the charge.

DETAILED DESCRIPTION OF THIS INVENTION

The table below provides non-limiting examples of mixtures from which a suitable briquette can be fashioned.

EXAMPLES OF BLENDED CHARGE IN BRIQUETTE FORM

| | | | | | |
|---|---|---|---|---|---|
| Carbon | C | 75 | 50 | 50 | 25 |
| Powdered iron | Fe | 25 | 25 | | |
| Dolime, lime, limestone, dolomite | CaO, MgO | | 25 | | |
| Aluminum powder | Al | | | 13 | |
| Iron oxide | $Fe_2O_3$ | | | 37 | 75 |
| TOTAL | | 100 | 100 | 100 | 100 |

In the table above, deviations from the indicated percentages may occur, up to about 5% to either side of the indicated level.

It is pointed out that the examples illustrated in the table above specify powdered iron or iron oxide. This teaching is not intended to be restrictive, as it is possible to use any one or a mixture of iron, chromium, nickel, iron oxide, chromium oxide and nickel oxide to achieve the same effect. Thus, wherever the words "iron" or "iron oxide" appear in this disclosure, the terms "nickel" or "nickel oxide", or the words "chromium" or "chromium oxide" can be substituted.

The above mixture of aluminum powder with iron oxide, in approximately stoichiometric proportions, is an exothermic blend which, upon burning, develops caloric heat which accelerates the melting of the metal scrap, and which generates alumina and iron units. The alumina will blend with the lime-dolime to create a calcium aluminate (an excellent flux for desulphurizing), while the iron units will revert to the bath, thus increasing its yield.

A similar effect will be obtained by using simply carbon and iron oxide plus a binder. (See the furthest right entry in the table.) In this case, the products of the reaction will be caloric heat as above, along with iron and $CO_2$. The $CO_2$ produced will have the effect of foaming the slag from underneath since the location where the $CO_2$ is generated will be buried within the charge. This will improve the electric are efficiency and shorten the melt time.

The dolime (or lime) addition mentioned above could be replaced with limestone and/or dolomite, which will produce $CO_2$ gas, with the same effect as above.

SPECIFIC EXAMPLE

A briquette having the following composition was made:

| | |
|---|---|
| 43.7% | Carbon |
| 22.5% | Fe |
| 12.2% | CaO |
| 6.6% | MgO |
| 2.9% | S |
| 12.1% | L.O.I. |

The L.O.I. is mainly generated by the decomposition of the dolomite and the binder used. The layer of CO and $CO_2$ produced will protect the bath from oxidation and enhance the carbon yield.

The manufacturing process by which the briquette is formed has the effect of densification, with the following typical values:

loose carbon prior to compression has a density of approximately 0.63 to 0.65 grams/cc. If a briquette is manufactured from the loose carbon only, the density can be raised into the range of 1.6 to 1.75 grams/cc. However, utilizing the formulation given at the beginning of this example, and compressing the formulation, will yield a density in the range of 2.4 to 2.6 grams/cc.

The densification due to compression has the effect of increasing the efficiency of the carbon addition, since the carbon is allowed to penetrate the bath, rather than simply floating on top of the bath.

While several embodiments of this invention have been described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. For addition to the charge in a steelmaking furnace, a briquette comprising:

from 1–10% by weight of a binder;

a first quantity of carbon fines;

a second quantity of a material in powdered form, selected from the group consisting of iron, chromium, nickel, iron oxide, chromium oxide, nickel oxide, and any mixtures thereof, thereby to densify the briquette;

said second quantity being large enough to suppress the slippery nature of the carbon fines, said second quantity being in the range from about 25% to about 75%, by weight, of the briquette.

2. The briquette claimed in claim 1, in which the material in powdered form is iron powder.

3. The briquette claimed in claim 2, in which the weight ratio of carbon fines to iron powder is about 3 to 1.

4. The briquette claimed in claim 1, in which the material in powdered form is iron oxide, and in which the briquette contains a third quantity of aluminum powder, the weight ratio of the iron oxide to the aluminum powder being about 3 to 1.

5. The briquette claimed in claim 4, in which the carbon fines constitute about ½ of the total weight of the briquette apart from the binder.

6. The briquette claimed in claim 1, in which the material in powdered form is iron oxide, the weight ratio of the iron oxide to the carbon fines being about 3 to 1.

7. The briquette claimed in claim 2, in which, apart from the binder, about 50% of the total briquette weight is carbon fines, about 25% of the total briquette weight is powdered iron, and the remainder of the total briquette weight is a substance selected from the group consisting of: lime, dolime, limestone, dolomite.

8. A method of improving the slag-covered charge in a steelmaking furnace, comprising the steps:

making a mixture of a first quantity of carbon fines obtained from dust collector fines, and a second quantity of a material in powdered form, the material being selected from the group consisting of iron, chromium, nickel, iron oxide, chromium oxide, nickel oxide, and any mixtures thereof, said second quantity densifying the mixture and being sufficient large that the slippery nature of the carbon fines is suppressed;

compressing a portion of said mixture in a mold to make a briquette; and introducing said briquette to the charge below the slag in the steelmaking furnace.

9. The method claimed in claim 8, in which said material in powdered form is iron powder.

10. The method claimed in claim 9, in which the weight ratio of carbon fines to iron is about 3 to 1, whereby, upon introducing the briquette to the charge, caloric heat is added thereto while iron and CO2 are generated, such that the CO2 foams the slag from underneath.

11. The method claimed in claim 8, in which the material in powdered form is iron oxide, and in which the briquette contains a third quantity of aluminum powder, the iron oxide and the aluminum powder being present in substantially stoichiometric proportions, such that the mixing together of the aluminum powder and the iron oxide develops caloric heat which accelerates the melting of the charge while generating alumina and iron units, whereupon the iron units revert to the bath, thus increasing its yield.

12. The briquette claimed in claim 1, in which the carbon fines constitute about ½ of the total weight of the briquette.

13. The method claimed in claim 8, in which said material is iron oxide in powdered form, the weight ratio of the iron oxide to the carbon fines being about 3 to 1.

14. The method claimed in claim 9, in which about 50% of the total briquette weight is carbon fines, about 25% of the total briquette weight is powdered iron, and the remainder of the total briquette weight is a substance selected from the group consisting of: lime, dolime, limestone, dolomite.

* * * * *